US008088027B2

(12) United States Patent
Torch

(10) Patent No.: US 8,088,027 B2
(45) Date of Patent: Jan. 3, 2012

(54) SWING TRAINING DEVICE

(76) Inventor: Joseph Torch, Towaco, NJ (US)

( * ) Notice: Subject to any disclaimer, the term of this patent is extended or adjusted under 35 U.S.C. 154(b) by 79 days.

(21) Appl. No.: 12/581,592

(22) Filed: Oct. 19, 2009

(65) Prior Publication Data

US 2011/0092318 A1 Apr. 21, 2011

(51) Int. Cl.
*A63B 69/00* (2006.01)

(52) U.S. Cl. ..... 473/453

(58) Field of Classification Search ..... 473/451–453, 473/257–260

See application file for complete search history.

(56) References Cited

U.S. PATENT DOCUMENTS 2,985,452 A * 5/1961 Trippet ..... 473/453
3,711,103 A * 1/1973 Seltzer ..... 473/229
5,029,852 A * 7/1991 Gilfillan ..... 473/417
5,595,384 A * 1/1997 Hardison, Jr. ..... 473/453
5,895,327 A * 4/1999 Francisco ..... 473/229
6,666,781 B1 * 12/2003 Illis ..... 473/453
2006/0089212 A1 * 4/2006 Marchel ..... 473/422
2008/0085788 A1 * 4/2008 Rainer et al. ..... 473/452
2008/0188331 A1 * 8/2008 Shimizu et al. ..... 473/451
2008/0248900 A1 * 10/2008 Hernandez ..... 473/453

* cited by examiner

*Primary Examiner* — Mark Graham

(57) ABSTRACT

A device to teach the proper mechanics of a baseball swing is described. The device consists of a platform that the batter stands on. Set in the platform is a wheel that the batter puts his back foot on. The wheel turns 90 degrees when the batter takes his stride showing the batter the proper way to turn his back foot so that his hips and torso rotate. The batters' front foot is guided by marks to indicate the starting and the ending position of his front foot during the swing. Attached to the platform is a guide that guides the swinging bat along the proper path to make optimal contact with the ball. The guide and platform are reversible for left hand batters, adjustable for batters of different heights and adjustable for high or low and inside or outside pitched balls.

4 Claims, 8 Drawing Sheets

SWING TRAINING DEVICE

BACKGROUND OF THE INVENTION

The hitting of a baseball has often been described as the single most difficult maneuvers in sport. The baseball swing can be broken down into two disciplines: Timing a delivery of the bat to the location of the ball at a precise time and the actual mechanics of that delivery. While the former discipline can be practiced, it is hard to teach in that it requires signals sent from the brain to the parts of the body. In effect, telling those parts when and where to move. The art, though, has many devices that help a batter practice the timing of the swing, the hand-eye coordination. The latter discipline can be taught in that it involves learning to move one's body parts in certain ways.

While there is still disagreement as to the correct mechanics of the perfect swing, most would agree that the maneuver requires the maximum potential available force be extended from the bat to the ball. There are 5 forward movements in the batters motion. Physics tells us that each of these forward movements delivers a certain force to the bat. That the sum of these forces will equal the force delivered to the bat. The optimum swing requires that each of these forward movements delivers its maximum attainable force. The procedure requires the coordinated movement of many parts of the body from head to toe and obtaining the maximum available force from the sum of these movements. To learn these coordinated movements and become proficient in their proper execution requires much practice.

The consensus today for the proper swing technique is to begin with a small step toward the pitcher with the batters front foot while at the same time rotating the back foot 90 degrees causing the hips and torso to rotate. As the torso rotates the batter's arms propel the bat in a downward arc toward the ball. This arc flattens out somewhat in the location of where the ball would be stuck. After the ball is struck the arms continue to propel the bat in an upward arc toward the pitcher. Many devices that try to help batters learn and practice the mechanics of the swing have been added to the art. U.S. Pat. No. 5,642,880 talks of mats and numbers on the ground to help batters with foot placement. U.S. Pat. No. 5,037,094 talks of a disc to help the back foot of a batter rotate, thereby causing the hips and torso to rotate. U.S. Pat. No. 5,029,852 shows a guide that would allow the bat to travel toward the ball in an arc.

All these devices teach a batter to work on particular areas of the body that will deliver the maximum potential available force from that area to the bat. Delivering the maximum potential available force from the bat to the ball requires that all these forces be added together in one coordinated effort. While all the above inventions, and others, show and allow the batter to practice proper techniques, there is no one device in the art that would allow for simultaneous practice of all these movements.

It would therefore be a significant advance of the art to provide one device that teaches a batter all the sequential movements the body has to make in order to deliver the maximum potential available force from the bat to the ball. It would also be a significant advance of the art to provide one device where the above mentioned movements could be practiced in repetition to allow the batter to perfect these moves. It would be a further advance in the art if this device could be used for left hand batters as well as right. And this device could be used to teach and practice the different movements that occur for pitches that are at different locations (I.E. high vs. low, inside vs. outside).

BRIEF SUMMARY OF THE INVENTION

The present invention relates generally to a device that teaches the proper swinging techniques to a hitter of a batted ball, more particularly to a device that teaches and allows the batter to practice the proper sequential movements of all the parts of the body that are involved in extending the maximum potential available force from the bat to the ball.

In particular one object of the invention is to provide a single device that would allow for all the movements involved in a swing to be learned and practiced at once.

Another object is to provide a device that can be easily changeable for batters of various heights.

Another object is to provide a device that can be easily changeable from right to left handed batters.

Another object is to provide a device that can be easily changeable to teach and practice proper body movements for balls that are pitched high, low or a middle level.

Still another object is to provide a device that can be easily changeable to teach and practice proper body movements for pitches that are inside or outside as well as down the middle.

DETAILED DESCRIPTION OF THE EMBODIMENTS

Figure 1:
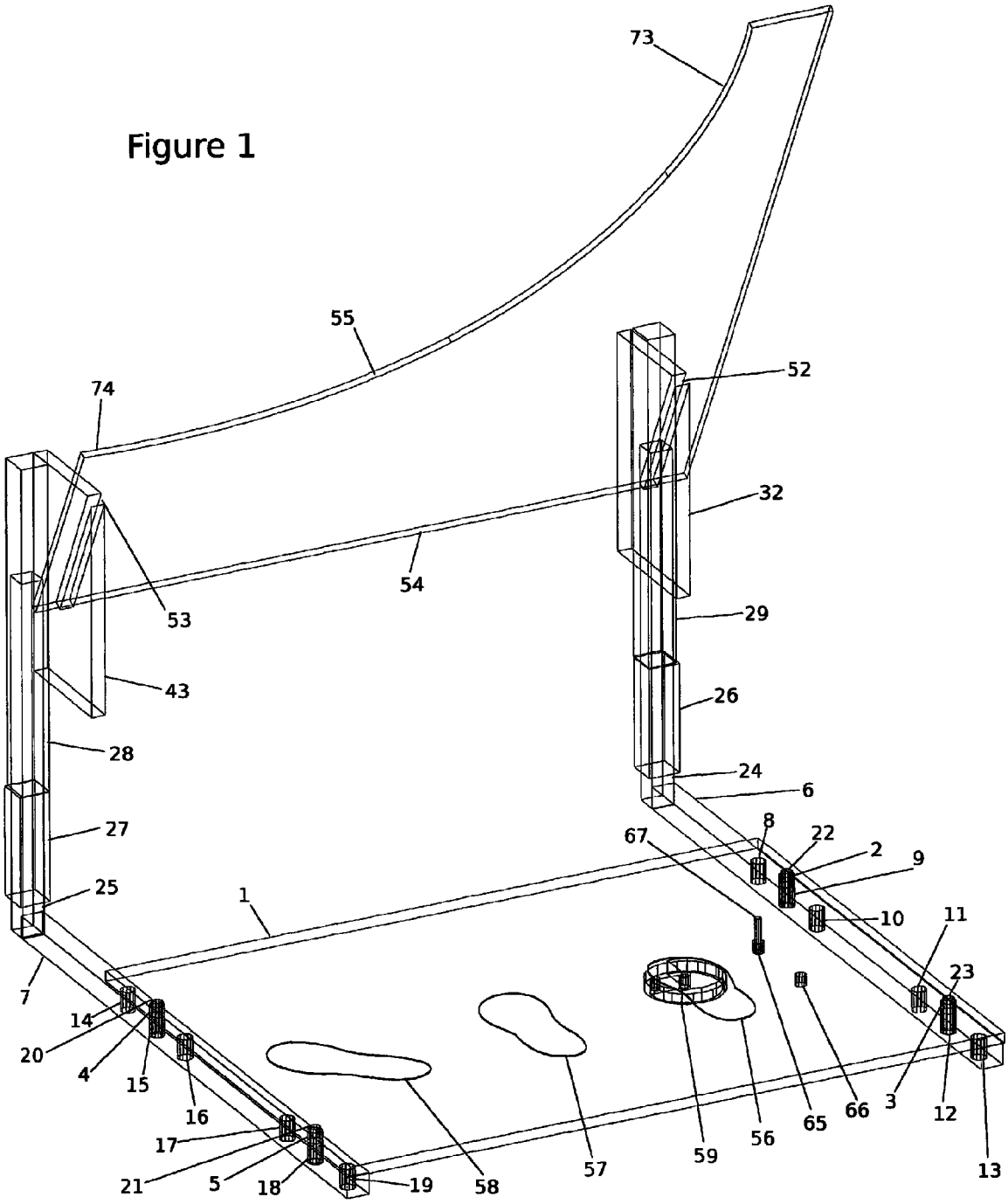
FIG. 1 is a perspective view of the entire device set for right handed batters.

In FIG. 1 platform 1 is shown with platform right forward alignment hole 2 and platform right back alignment hole 3 and left forward alignment hole 4 and left forward alignment hole 5. The platform is placed on right bottom brace 6 and left bottom brace 7 so that the platform right alignment holes 2 and 3 are over a set of corresponding right brace holes and the platform left alignment holes 4 and 5 are over a set of corresponding left brace holes. In this case right brace forward middle hole 9 and right brace back middle hole 12 and left brace forward middle hole 15 and left brace back middle hole 18. Pins 22, 23, 20 and 21 are placed through platform holes and brace holes to hold the platform and braces together.

Right upright brace 24 is attached to right bottom brace 6 at a 90 degree angle and left upright brace 25 is attached to left bottom brace 7 at a 90 degree angle. Medium spacer 26 is a hollow tube with a slightly larger diameter that the upright brace and slides over right upright brace 24. Likewise medium spacer 27 slides over left upright brace 25.

Figure 7:
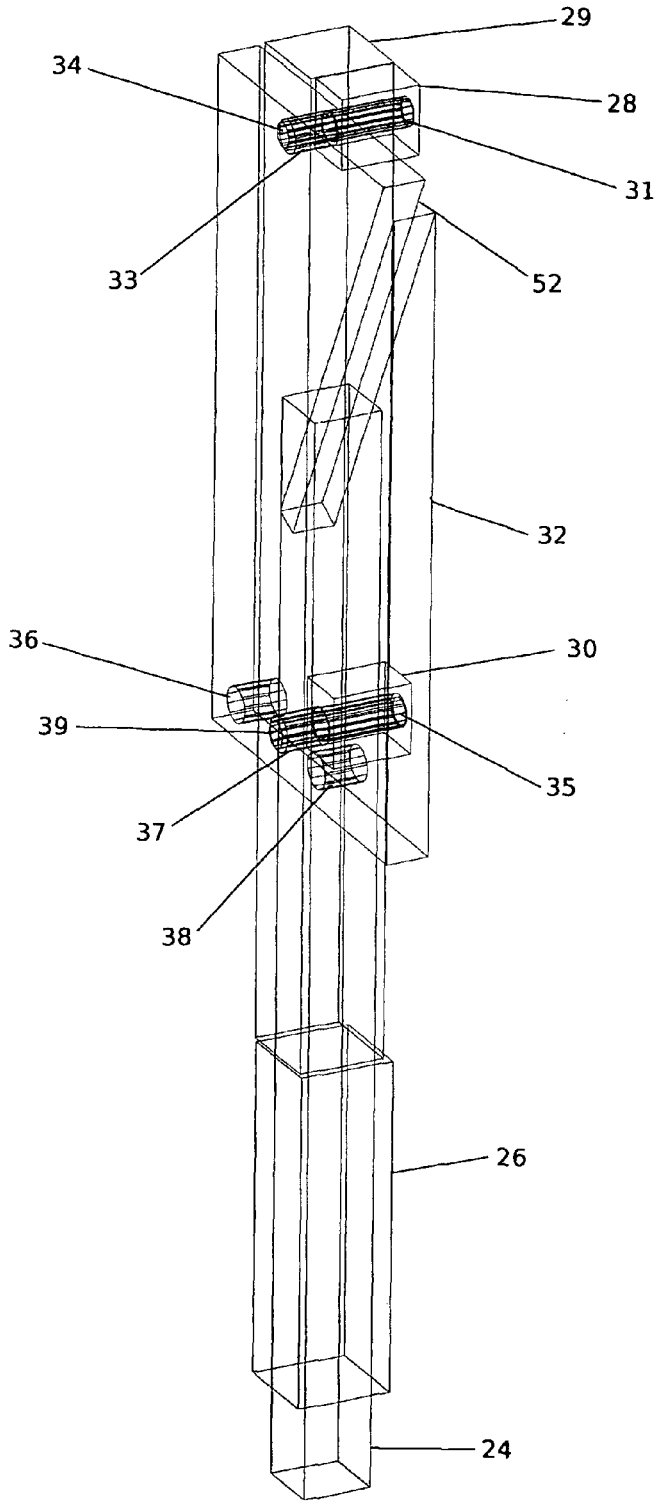
FIG. 7 is a perspective view showing right bracket assembly.

FIG. 7 shows close up of bracket assembly. Right bracket extension top connector 28 is attached to right bracket extension 29. Right bracket extension top connector 28 has in it hole 31. Right adjustable bracket 32 is shown with top fastening hole 33. Bolt 34 is placed thru hole 31 and top fastening hole 33 and secured. Right bracket extension bottom connector 30 is attached to right bracket extension 29. Right bracket extension bottom connector 30 has in it hole 35. Right adjustable bracket 32 is shown with bottom front fastening hole 36, bottom middle fastening hole 37, bottom back fastening hole 38. Bolt 39 is placed thru hole 35 and, in this case, bottom middle fastening hole 37 and secured. Placement of the bolt 39 thru the front fastening hole 36 on the right and left adjustable brackets allows the guide to be adjusted closer to the batter. While placement of the bolt 39 thru the back fastening hole 38 on the right and left adjustable brackets allows the guide to be adjusted farther away from the batter. Right bracket extension 24 is a hollow tube with a slightly larger diameter than the upright brace and, after it and right adjustable bracket 32 are assembled, slides over right upright brace 24.

FIG. 1 shows left adjustable bracket 43 connected to left bracket extension 25 in the same way as the right adjustable bracket and the right bracket extension connects. Right slot 52 is shown cut into right adjustable bracket 32. And left slot 53 is shown cut into left adjustable bracket 43. Bat guide 54 is placed into these slots and is held in place to left adjustable bracket 43 and right adjustable bracket 32. Bat guide 54 has guide arced edge 55 going from top 73 to bottom 74 and right to left. The guide is set at an arc to allow for the proper path the bat needs to follow.

Figure 8:
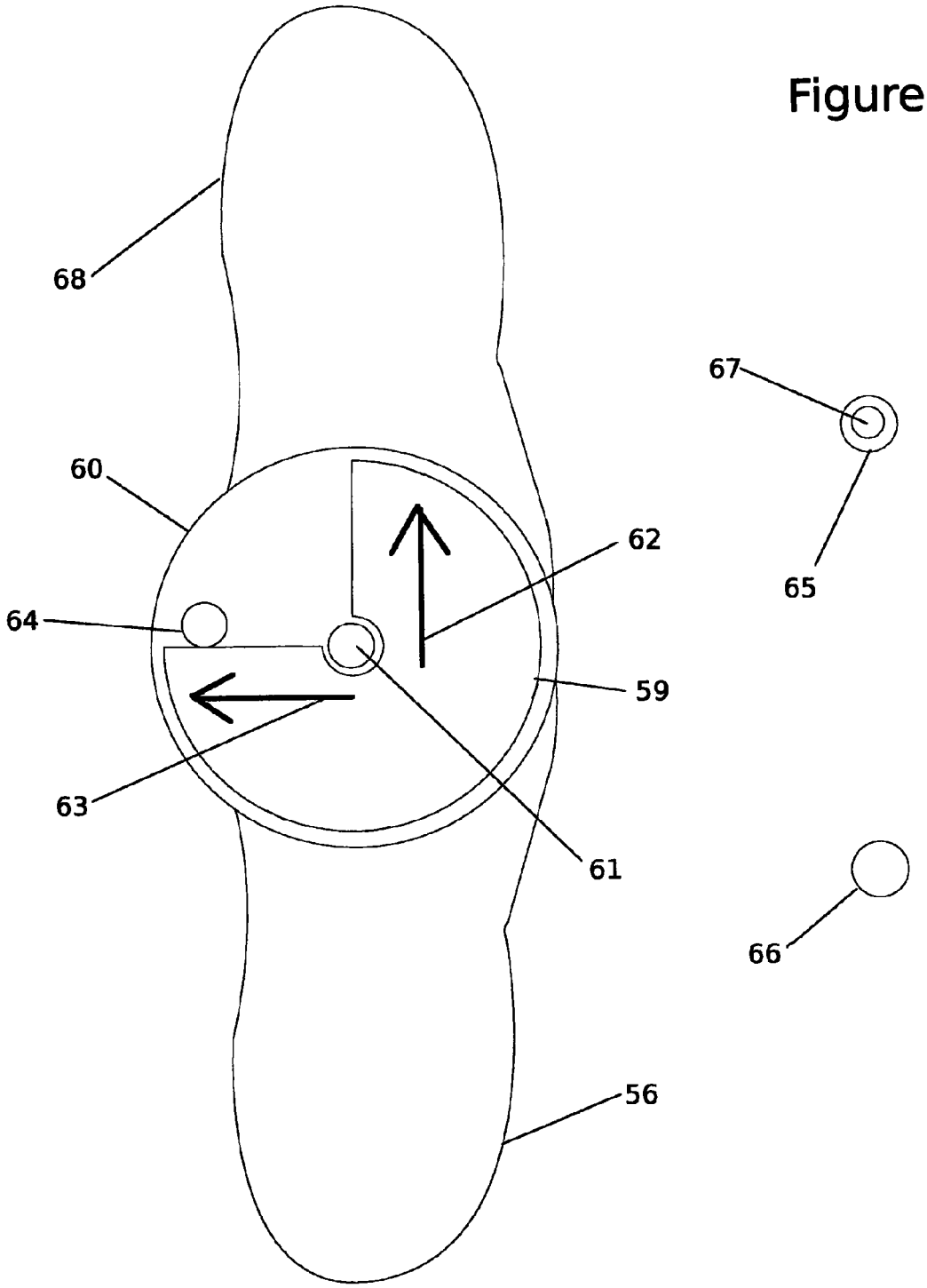
FIG. 8 is a perspective view showing wheel assembly.

Also in FIG. 1 foot markings for right handed batter. Back foot mark 56 shows location where back foot is to be placed at the start of the swing. Front foot mark 57 shows location where front foot is to be placed at the start of the swing. Ending foot mark 58 shows location where front foot is to be placed at the end of the swing. Pivot wheel 59 is placed thru partial hole in platform 60 and secured with axle 61. FIG. 8 shows a close up of the pivot wheel. Pivot wheel 59 has in it a 90 degree cut out, with arrow A 62 on one side of the cutout facing toward the bat guide. Arrow B 63 is facing toward the batters front foot. During operation the batters toe area of the back foot is placed over the cutout. Pivot wheel stop 64 allows wheel only to rotate the 90 degrees between cutout. The wheel stop 64 rests against arrow B 63 at the start of the rotation and, as the back foot pivots it forces the wheel to rotate counterclockwise during the swing, rests against arrow A 62 at the end of the swing. Right heel limiting hole 65 is in platform at a point in parallel to the top outside of the wheel 59. Left heel limiting hole 66 is in platform at a point in parallel to the bottom outside of the wheel 59. Flexible stop 67 may be placed in right heel limiting hole 65 to limit over rotation of the back foot during swing of a right handed batter.

Figure 2:
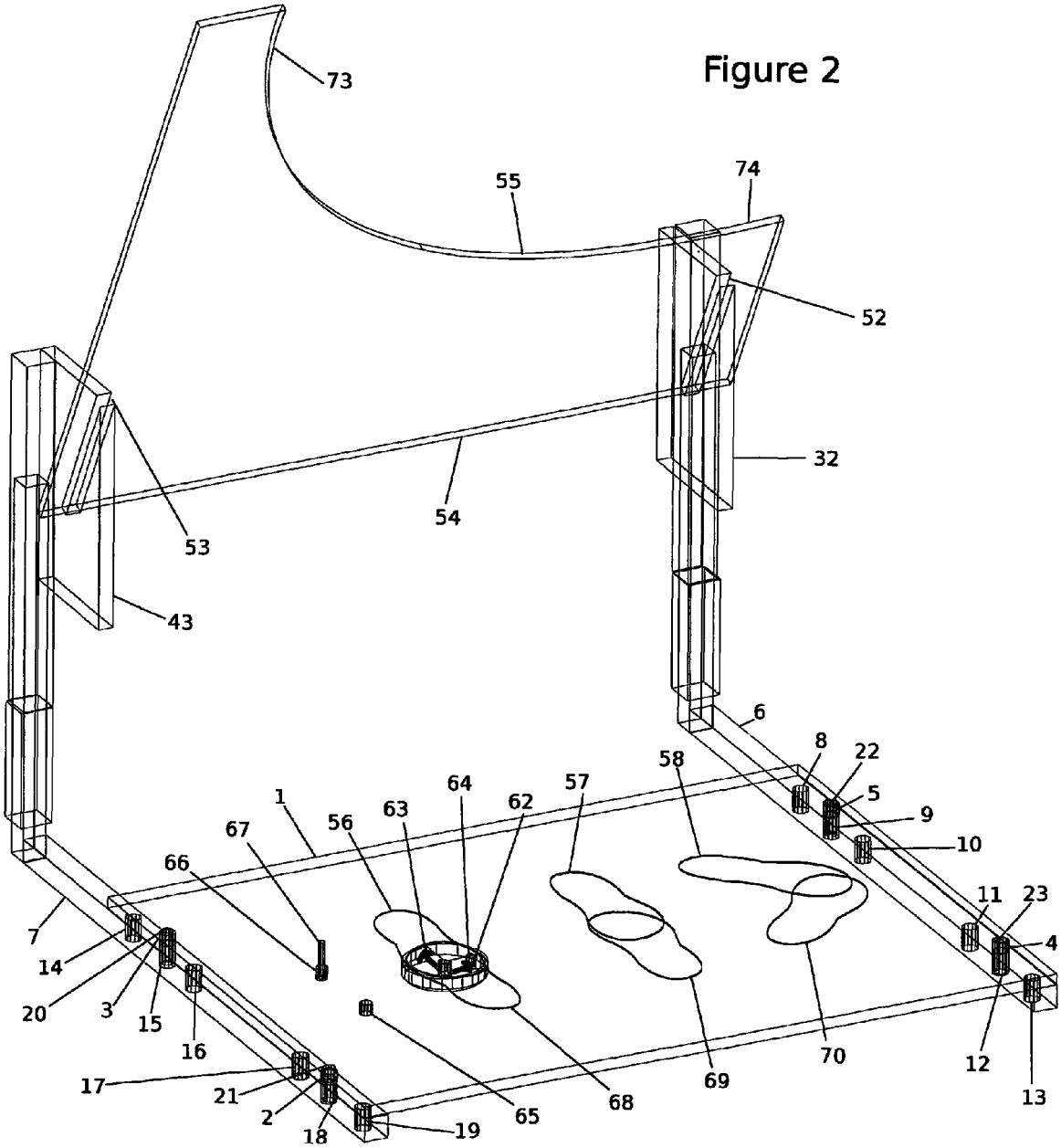
FIG. 2 is a perspective view of the entire device set for left hand batters.

FIG. 2 shows device assembled for left a hand batter. Platform 1 is flipped end for end so that the platform right alignment holes 2 and 3 are over a set of corresponding left brace holes. Right platform alignment hole 2 is over left brace back middle hole 18. Right platform alignment hole 3 is over left brace forward middle hole 15. Platform left alignment holes 4 and 5 are over a set of corresponding right brace holes. Left platform alignment hole 4 is over right brace back middle hole 12. Left platform alignment hole 5 is over right brace forward middle hole 9. Pins 22, 23, 20 and 21 are placed through platform holes and brace holes to hold the platform and braces together.

Bat guide 54 is flipped end for end and placed in the left adjustable bracket 43 and right adjustable bracket 32. The bat guide's arced edge 55 still goes from top 73 to bottom 74 but in this case goes left to right. Also shown in FIG. 2, are the foot markings for left hand batter. Back foot mark 68 shows location where back foot is to be placed at the start of the swing. Front foot mark 69 shows location where front foot is to be placed at the start of the swing. Ending foot mark 70 shows location where front foot is to be placed at the end of the swing.

The wheel stop 64 rests against arrow A 62 at the start of the rotation and, as the back foot pivots it forces the wheel to rotate clockwise during the swing, rests against arrow B 63 at the end of the swing. Left heel limiting hole 66 is in platform at a point in parallel to the bottom outside of the wheel 59. Flexible stop 67 may be placed in left heel limiting hole 66 to limit over rotation of the back foot during swing of a left hand batter.

Figure 3:
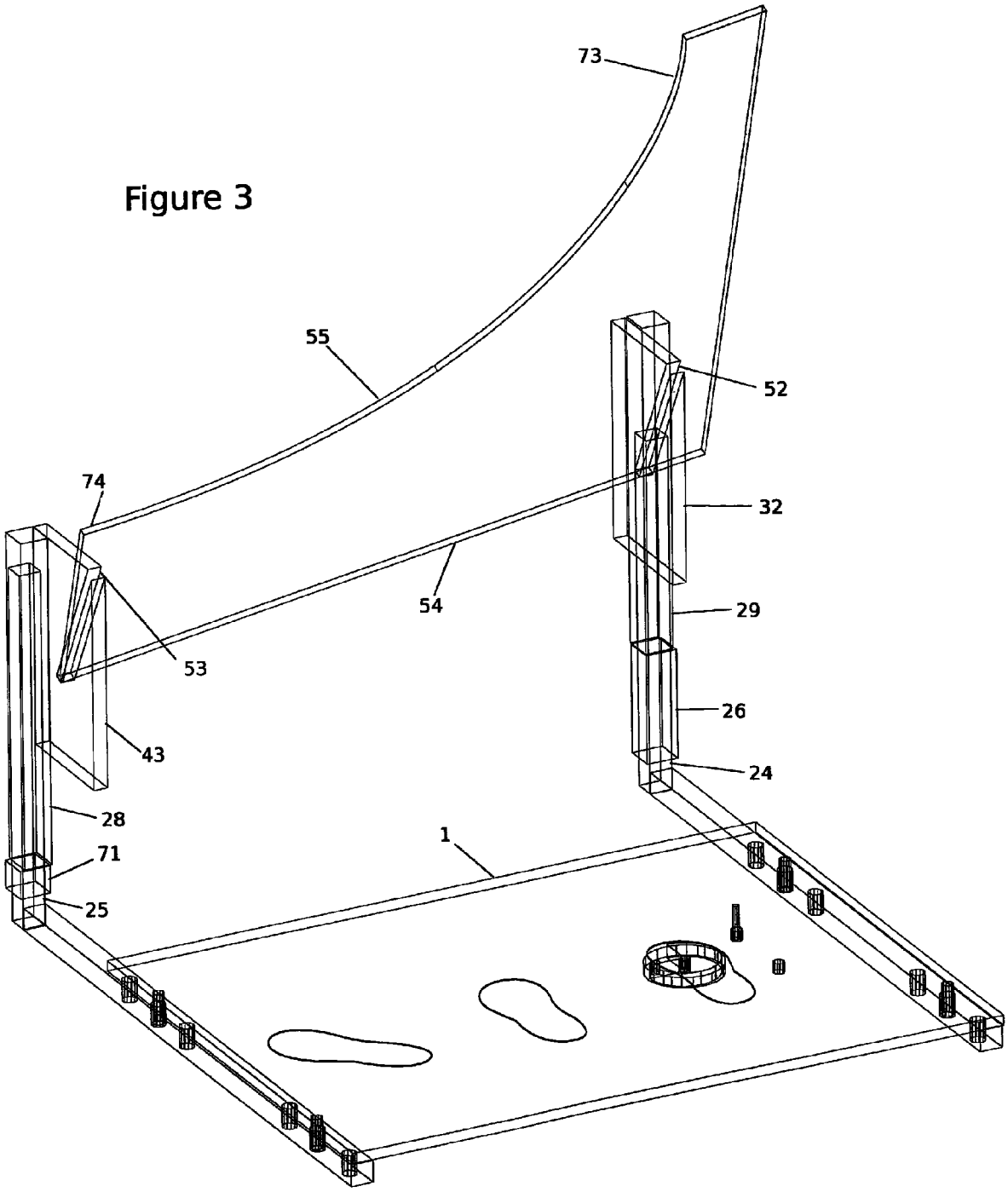
FIG. 3 is a perspective view of the entire device set for right handed batters showing the set up to demonstrate a swing for a ball pitched low.

FIG. 3 shows device assembled for the proper swing technique for a ball pitched low. This device can be adjusted to allow the batter to practice balls pitched to low strike zone locations. By switching a medium spacer with a small spacer 71, the left bracket extension 28 sits in a lower position over left upright brace 25. This causes the one side of the bat guide 54 to drop. This makes lower edge of bat guide 74 to be closer to the ground. This allows that practice swing to finish at a lower position in relationship to the ground.

Figure 4:
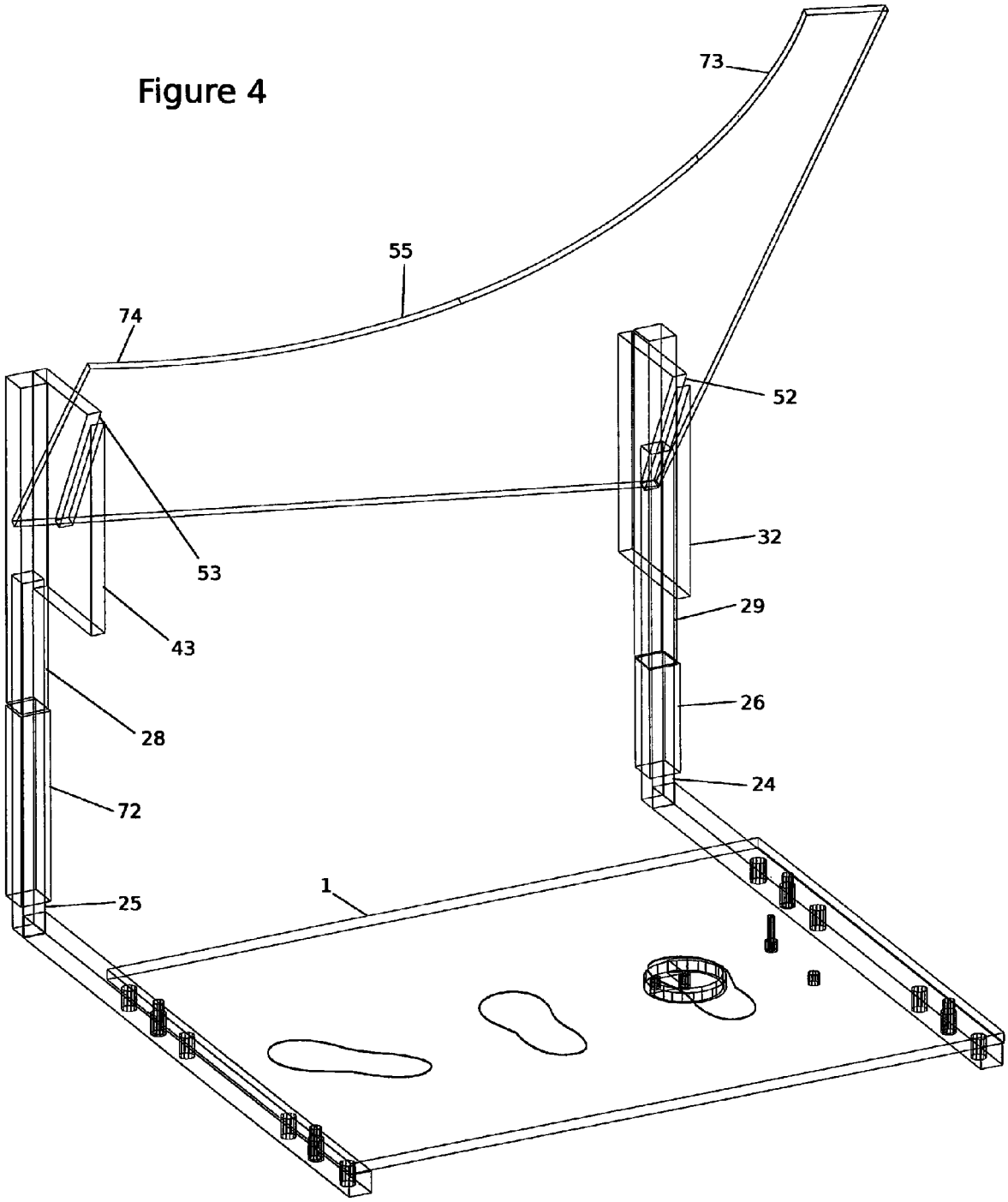
FIG. 4 is a perspective view of the entire device set for right handed batters showing the set up to demonstrate a swing for a ball pitched high.

FIG. 4 shows device assembled for the proper swing technique for a ball pitched high. By switching a medium spacer with a large spacer 72 the left bracket extension 28 sits in a higher position over left upright brace 25. This causes the one side of the bat guide 54 to rise. This makes lower edge of bat guide 74 to be farther away from the ground. This allows that practice swing to finish at a higher position in relationship to the ground. For a left or right handed configuration, the spacer under the lower part of the batting arc is always the spacer that is moved. The spacer under the higher part of the batting arc is left alone. When adjusting to batters of different heights, both spacers are fitted simultaneously. For a short batter, two small spacers would be use. Likewise for a taller batter, two large spacers would be used.

Figure 5:
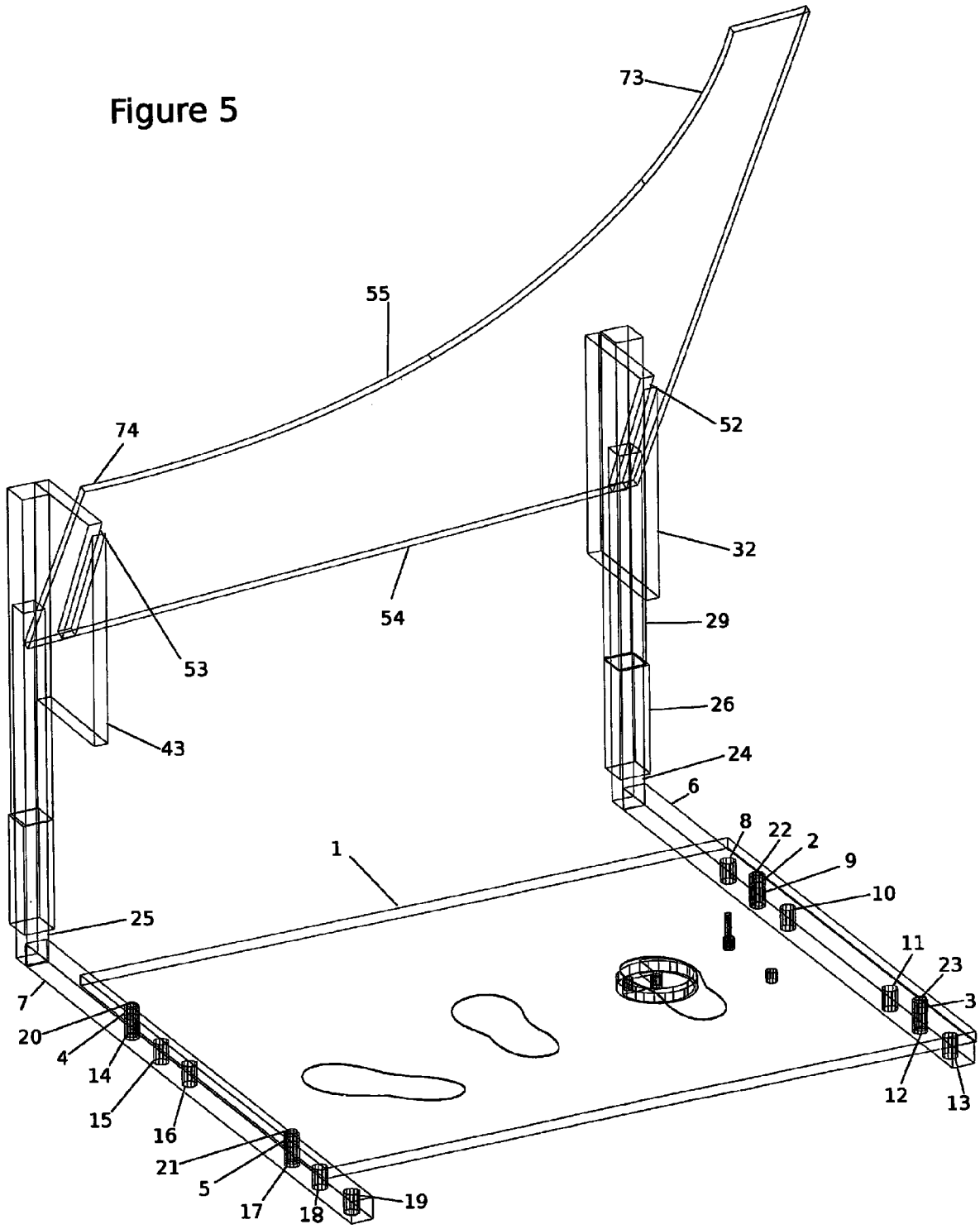
FIG. 5 is a perspective view of the entire device set for right handed batters showing the set up to demonstrate a swing for an ball pitched inside.

FIG. 5 shows device assembled for the proper swing technique for a ball pitched inside. The platform 1 is aligned so that the platform right alignment holes 2 and 3 are over a set of corresponding right brace holes and the platform left alignment holes 4 and 5 are over a set of corresponding left brace holes. In this case, platform right alignment hole 2 is over right brace forward middle hole 9 and platform right alignment hole 3 is over right brace back middle hole 12. Platform left alignment hole 5 is over left brace back top hole 17 and platform left alignment hole 4 is over left brace forward top hole 14. For left hand batters this would be just the opposite. Pins 22, 23, 20 and 21 are placed through platform holes and brace holes to hold the platform and braces together. The ending point 74 of bat guide edge 55 moves closer to the batter. Because the batter is taught to keep their hands as close to the bat guide edge 55 as possible, the batters hands and therefore the bat are moved inside. This allows the batter to practice the movements necessary to hit inside pitches.

Figure 6:
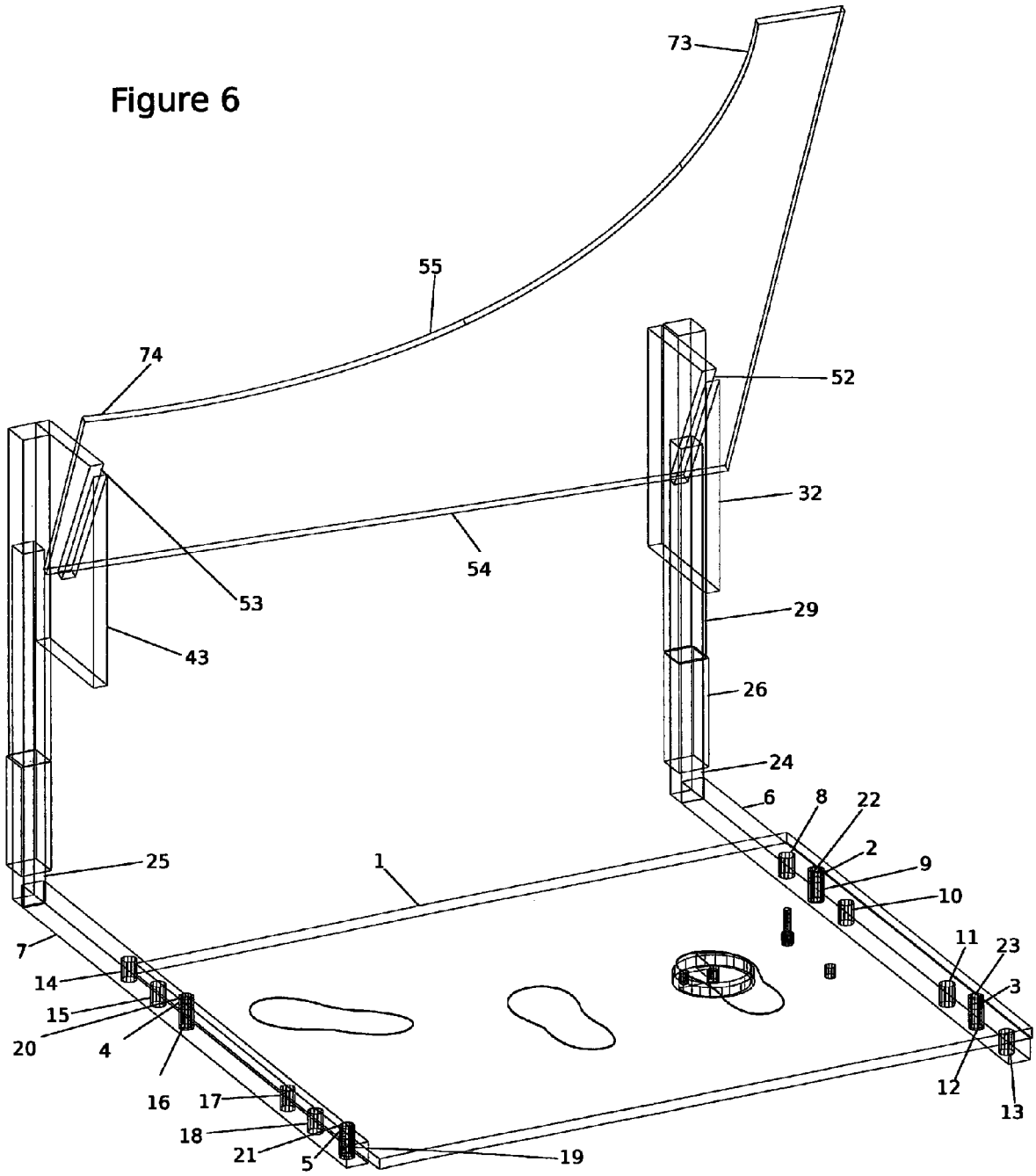
FIG. 6 is a perspective view of the entire device set up to demonstrate a swing for a ball pitched outside.

FIG. 6 shows device assembled for the proper swing technique for a ball pitched outside. The platform 1 is aligned so that the platform right alignment holes 2 and 3 are over a set of corresponding right brace holes and the platform left alignment holes 4 and 5 are over a set of corresponding left brace holes. In this case, platform right alignment hole 2 is over right brace forward middle hole 9 and platform right alignment hole 3 is over right brace back middle hole 12. Platform left alignment hole 5 is over left brace back bottom hole 19 and platform left alignment hole 4 is over left brace forward bottom hole 16. For left hand batters this would be just the opposite. Pins 22, 23, 20 and 21 are placed through platform holes and brace holes to hold the platform and braces together. The ending point 74 of bat guide edge 55 moves farther away from the batter. The batters hands and therefore the bat are moved farther away. This allows the batter to practice the movements necessary to hit outside pitches.

In operation, in FIG. 1, the batter stands upon the platform 1 with his front foot within the starting front foot mark 57 and the back foot within the back foot mark 56. The back toe area is placed over the cutout area of the pivot wheel 59. As the batter starts the swing his back foot pivots and the pivot wheel 59 turns to a point where the wheel stop 64 prevents further rotation. At the same time the front foot moves to the ending front foot mark 58. At the start of the swing, the handle of the bat rests against the bat guide edge 55 at the bat starting point 73. The hands are just below this point. Simultaneously as the feet are moved and the body rotates, the bats handle glides along the bat guide edge 55 from bat starting point 73 to bat ending point 74. The batters hands should stay in a position close to the bat guide edge 55 as the bat moves along the edge. This insures proper movements of the arms and shoulders during the swing.

While the above is the preferred embodiment of the invention, many modifications may become apparent to those skilled in the art and these should be considered within the scope and spirit of the invention as defined by the following claims.

REFERENCES

U.S. Pat. No. 3,341,208 Marcella
U.S. Pat. No. 4,932,656 Pierce
U.S. Pat. No. 5,029,852 Gilfillan
U.S. Pat. No. 5,037,094 Johnson
U.S. Pat. No. 5,322,276 Hardison, Jr. et al.
U.S. Pat. No. 5,330,176 Cagney, Jr
U.S. Pat. No. 5,595,384 Hardison, Jr. et al.
U.S. Pat. No. 5,642,880 Wiseman, et al.
U.S. Pat. No. 7,090,599 Hedgepath
U.S. Pat. No. 7,125,350 Reason-Kerkhoff
U.S. Pat. No. 7,335,117 Reason-Kerkhoff

I claim:

1. A training device that teaches, and allows for repetitive practice of, the proper movements of a correct baseball swing comprising:

A. a platform for the batter to stand;

B. a plurality of marks on said platform to indicate proper foot placement;

C. a pivot wheel attached to said platform;

D. a left and a right upright extension attached to said platform, said extensions capable of being adjusted independently of one and other both up and down and closer to or farther from the batter;

E. means to attach a guide to said extensions;

F. a guide that allows a swinging bat to follow along a path, said path in an arced pathway that allows the proper path from start of swing until point of contact position, said arced pathway starting in a higher mostly vertical plane and moving to a lower mostly horizontal plane.

2. A device according to claim 1, wherein guide has a path with an edge that lets a bat handle travel along.

3. A device according to claim 1, wherein the lower side of the guide has means to be adjustable, on said left or right extension, to be closer or farther away from the batter's standing position while keeping the higher side of the guide in the same position relative to the batter's standing position.

4. A device according to claim 1, wherein one guide attachment means can be raised or lowered upon said left or right upright extensions while keeping the other guide attachment means unchanged on the other upright extension.

* * * * *